US007201148B2

(12) United States Patent
Nakane

(10) Patent No.: US 7,201,148 B2
(45) Date of Patent: Apr. 10, 2007

(54) PRESSURE ACCUMULATION FUEL INJECTION CONTROLLER

(75) Inventor: Noriaki Nakane, Komaki (JP)

(73) Assignee: Denso Corporation, Kariya, Aichi-pref. (JP)

( * ) Notice: Subject to any disclaimer, the term of this patent is extended or adjusted under 35 U.S.C. 154(b) by 0 days.

(21) Appl. No.: 11/481,883

(22) Filed: Jul. 7, 2006

(65) Prior Publication Data

US 2007/0017485 A1 Jan. 25, 2007

(30) Foreign Application Priority Data

Jul. 19, 2005 (JP) ..... 2005-208649

(51) Int. Cl.
*F02M 37/04* (2006.01)

(52) U.S. Cl. ..... 123/456; 123/494; 123/514

(58) Field of Classification Search ..... 123/456, 123/506, 446, 447, 494, 357; 73/119 A
See application file for complete search history.

(56) References Cited

U.S. PATENT DOCUMENTS 6,209,522 B1 * 4/2001 Onishi et al. ..... 123/458
6,349,702 B1 * 2/2002 Nishiyama ..... 123/456
6,612,292 B2 * 9/2003 Shirakawa ..... 123/501
6,694,953 B2 * 2/2004 Barnes et al. ..... 123/500
6,712,045 B1 * 3/2004 McCarthy, Jr. ..... 123/456
6,889,666 B2 * 5/2005 Oono ..... 123/514
2002/0139350 A1 * 10/2002 Barnes et al. ..... 123/456
2005/0081826 A1 * 4/2005 Yu et al. ..... 123/456

FOREIGN PATENT DOCUMENTS

JP 11-148400 6/1999

* cited by examiner

*Primary Examiner*—Carl S. Miller
(74) *Attorney, Agent, or Firm*—Nixon & Vanderhye P.C.

(57) ABSTRACT

A pressure pattern estimation device of a fuel injection controller of an engine estimates a pressure transition of fuel in a common rail. A surplus pressure range calculation device of the fuel injection controller calculates a surplus pressure range in which pressure pattern data provided by the pressure pattern estimation device exceeds a target common rail pressure. The fuel injection controller releases the common rail pressure to a lower-pressure side by operating a pressure reduction valve of the common rail to eliminate the surplus pressure range calculated by the surplus pressure range calculation device. Thus, the common rail pressure (injection pressure) during an injection period is smoothed.

10 Claims, 3 Drawing Sheets

PRESSURE ACCUMULATION FUEL INJECTION CONTROLLER

CROSS REFERENCE TO RELATED APPLICATION

This application is based on and incorporates herein by reference Japanese Patent Application No. 2005-208649 filed on Jul. 19, 2005.

BACKGROUND OF THE INVENTION

1. Field of the Invention

The present invention relates to a pressure accumulation fuel injection controller used mainly in a diesel engine.

2. Description of Related Art

A pressure accumulation fuel injection device having a pressure accumulation vessel (common rail), a fuel injection valve (injector) and a suction metering fuel supply pump is known as a fuel injection device for a diesel engine. The pressure accumulation vessel accumulates high-pressure fuel according to a fuel injection pressure. The injector injects and supplies the high-pressure fuel in the accumulation vessel into each cylinder of the engine. The supply pump pressurizes the fuel suctioned into a pressurization chamber to high pressure and pressure-feeds the fuel to the pressure accumulation vessel.

Common rail pressure in the pressure accumulation vessel of the conventional pressure accumulation fuel injection device invariably fluctuates in a waveform because the common rail pressure receives pulsation of the fuel supply pump driven by the engine. In this case, a fuel injection amount differs depending on which point of the waveform of the pressure fluctuation coincides with the injection period of the fuel injection valve. The injection amount changes due to the fluctuation of the pressure during the injection. For example, the injection amount becomes large if the fuel injection is performed at a high point of the pressure fluctuation waveform. The injection amount becomes small if the fuel injection is performed at a low point of the pressure fluctuation waveform. Therefore, conventionally, the common rail pressure at the time when the fuel injection valve erupts the fuel is read in, and control for achieving the same injection amount is performed by regulating the injection period based on the fuel eruption pressure.

The fuel is atomized quite minutely if the eruption pressure is high when the control for achieving the same injection amount is performed. In this case, the fuel burns easily and cleanly so as to inhibit generation of smoke and to improve combustion efficiency. However, the fuel is not atomized well when the eruption pressure is low. In this case, the fuel is difficult to burn and the smoke can be generated easily, deteriorating the combustion efficiency. Accordingly, the combustion is not stabilized, so engine performance varies and is destabilized. The fuel supply pump may be controlled as a countermeasure. However, the control of the fuel supply pump is difficult because the fuel supply pump works with the engine.

JP-A-H11-148400 describes a pressure accumulation fuel injection device that has a pressure reduction valve (discharge valve) for releasing the pressure accumulation vessel to a lower pressure side. The fuel injection device opens the pressure reduction valve under a certain operation condition (for example, an acceleration operation resumed immediately after rapid deceleration of the engine or operation immediately after shift-up) in which the fuel pressure in the pressure accumulation vessel exceeds a target value. Thus, the fuel injection device avoids an excessive injection rate and inhibits diesel knocking or discharge of nitrogen oxides (NOx).

The fuel injection device of JP-A-H11-148400 functions as a failsafe device for handling an abnormality in a specific operation state such as acceleration resumed immediately after rapid deceleration or operation immediately after shift-up. However, this fuel injection device does not invariably control the pressure reduction valve. Therefore, problems of instable combustion of the engine and variation or instability of the engine performance still remain.

SUMMARY OF THE INVENTION

It is an object of the present invention to provide a pressure accumulation fuel injection controller that improves injection amount accuracy of a fuel injection valve and achieves a stable combustion state and stable operation performance by smoothing an injection pressure during an injection period.

According to an aspect of the present invention, a pressure accumulation fuel injection controller has a pressure accumulation vessel for accumulating high-pressure fuel, a fuel injection valve for injecting the high-pressure fuel accumulated in the pressure accumulation vessel into respective cylinders of an engine, and a fuel supply pump for pressurizing suctioned fuel and for pressure-feeding the fuel to the pressure accumulation vessel. The fuel injection controller has a pressure pattern estimation device, a surplus pressure range calculation device and a pressure reduction valve. The pressure pattern estimation device is configured with an injection period based on a required injection amount and a target common rail pressure and estimates a pressure transition of the fuel in the pressure accumulation vessel during the injection period. The surplus pressure range calculation device is configured with the target common rail pressure based on pressure pattern data provided by the pressure pattern estimation device and calculates a surplus pressure range in which the pressure pattern data during the injection period exceeds the target common rail pressure. The pressure reduction valve discharges the common rail pressure to a lower-pressure side to eliminate the surplus pressure range calculated by the surplus pressure range calculation device. Thus, the injection pressure during the fuel injection period of the fuel injection valve is smoothed. As a result, a stable combustion state can be obtained and operation performance can be stabilized.

BRIEF DESCRIPTION OF THE DRAWINGS

Features and advantages of an embodiment will be appreciated, as well as methods of operation and the function of the related parts, from a study of the following detailed description, the appended claims, and the drawings, all of which form a part of this application. In the drawings:

DETAILED DESCRIPTION OF EXAMPLE EMBODIMENT

Figure 1:
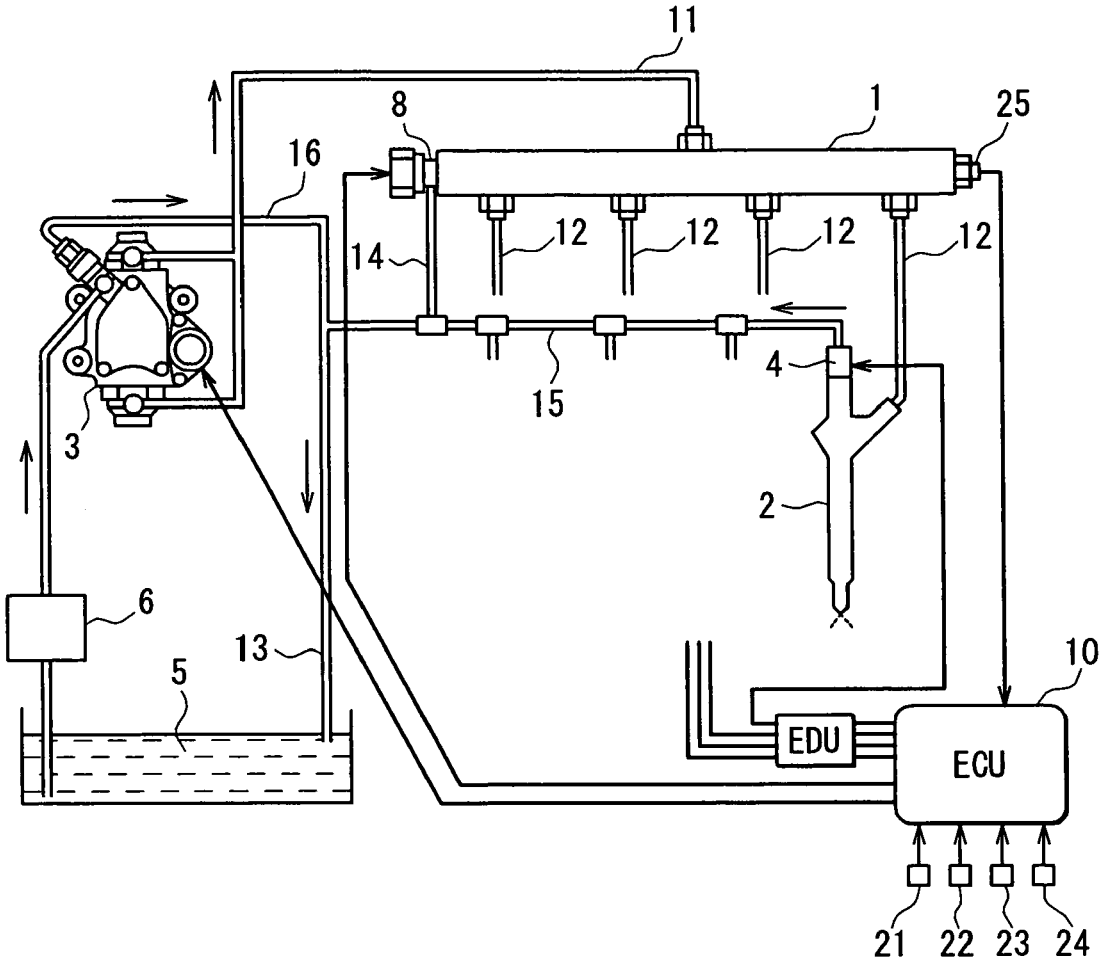
FIG. 1 is a schematic diagram showing a pressure accumulation fuel injection controller according to an example embodiment of the present invention.

Referring to FIG. 1, a pressure accumulation fuel injection controller according to an example embodiment of the present invention is illustrated. The fuel injection controller has a pressure accumulation vessel (common rail) 1, multiple (four, in the present embodiment) fuel injection valves (injectors) 2, a fuel supply pump (supply pump) 3, and an electronic control unit (ECU) 10. The common rail 1 provides a pressure accumulation chamber for accumulating high-pressure fuel according to a fuel injection pressure. The multiple injectors 2 are connected with the common rail 1 and inject the fuel into respective cylinders of a four-cylinder engine such as a multi-cylinder diesel engine. The supply pump 3 is rotated and driven by the engine. The ECU 10 functions as a control section for electronically controlling the multiple injectors 2 and the supply pump 3.

The common rail 1 needs to continuously accumulate the high pressure corresponding to the fuel injection pressure. Therefore, the supply pump 3 supplies the high-pressure fuel to the common rail 1 through a high-pressure flow passage 11. The injector 2 of each cylinder is an electromagnetic fuel injection valve having a fuel injection nozzle, an electromagnetic actuator, and a biasing member such as a spring. The fuel injection nozzle is connected to a downstream end of each one of high-pressure flow passages 12 branching from the common rail 1 and performs the fuel injection into each cylinder of the engine. The electromagnetic actuator drives a nozzle needle accommodated in the fuel injection nozzle in a valve opening direction. The biasing member biases the nozzle needle in a valve closing direction. The fuel injection from each injector 2 to the engine is electronically controlled through energization and de-energization (ON/OFF) of an injection control electromagnetic valve 4 as the electromagnetic actuator that controls a back pressure of the nozzle needle of the fuel injection nozzle. The high-pressure fuel accumulated in the common rail 1 is injected and supplied into each cylinder of the engine while the injection control electromagnetic valve 4 of the injector 2 of the cylinder is open.

The supply pump 3 has an already-known feed pump (low-pressure supply pump, not shown), plungers (three plungers in the present embodiment, not shown) and pressurization chambers (not shown). The feed pump draws low-pressure fuel from a fuel tank 5 if a pump drive shaft rotates in accordance with rotation of a crankshaft of the engine. The plungers are driven by the pump drive shaft. The pressurization chambers pressurize the fuel through reciprocating movement of the plungers. The supply pump 3 is a high-pressure supply pump that pressurizes the low-pressure fuel, which is suctioned from the fuel tank 5 by the feed pump through a filter 6, to high pressure and pressure-feeds the fuel to the common rail 1 through a high-pressure flow passage 11. A suction metering pump electromagnetic valve 7 as an electromagnetic actuator is attached to a fuel flow passage leading from the feed pump to the pressurization chambers of the supply pump 3. The pump electromagnetic valve 7 regulates an opening degree of the fuel flow passage to change an amount of the fuel discharged (pressure-fed) from the supply pump 3 to the common rail 1.

The pump electromagnetic valve 7 is a suction metering valve that is electronically controlled by a pump drive signal output from the ECU 10 to meter a suction amount of the fuel suctioned into the pressurization chambers of the supply pump 3. The pump electromagnetic valve 7 changes the pump discharge amount to control the common rail pressure corresponding to the fuel injection pressure of the fuel injected from the respective injectors 2 to the respective cylinders of the engine. The pump electromagnetic valve 7 operates in a direction for increasing the pump discharge amount (valve opening degree) further as the pump drive signal (drive current) supplied by the ECU 10 increases. The control of the drive current to the pump electromagnetic valve 7 should be preferably performed by duty cycle control. Highly accurate digital control can be performed through the duty cycle control of changing the valve opening degree of the pump electromagnetic valve 7 by regulating a ratio (energization time ratio, duty ratio) of ON/OFF of the pump drive signal per unit time.

The common rail 1 has a pressure reduction valve 8 that opens and closes a flow passage 14 leading to a low-pressure flow passage 13 communicating with the fuel tank 5. Thus, the pressure in the common rail 1 can be reduced. The pressure reduction valve 8 is an electromagnetic valve, an operation of which is controlled by duty cycle control like the pump electromagnetic valve 7.

Leak fuel from the injectors 2 and the supply pump 3 is returned to the fuel tank 5 through low-pressure flow passages 15, 16 and the low-pressure flow passage 13.

The ECU 10 has a microcomputer of an already-known structure having functions of CPU for performing control processing and computation processing, a storage device (EEPROM, RAM) for storing various types of programs and data, an input circuit, an output circuit, a power source circuit, a pump drive circuit and the like. Sensor signals from various sensors are input to the microcomputer after A/D conversion of the signals is performed by an A/D converter.

The ECU 10 has an injection amount/injection timing control device for performing injection amount control and injection timing control of the injector 2 of each cylinder. The injection amount/injection timing control device has an injection amount/injection timing calculation device, an injection pulse width calculation device and an injector drive device. The injection amount/injection timing calculation device calculates the optimum injection timing (injection start timing) and a target (required) injection amount (injection period) in accordance with the engine operation condition. The injection pulse width calculation device calculates an injector injection pulse of an injection pulse period (injection pulse width TQ) in accordance with the engine operation condition and the target injection amount. The injector drive device applies an injector injection pulse to the injection control electromagnetic valve 4 of the injector 2 of each cylinder through an injector drive circuit (EDU).

The ECU 10 calculates the target injection amount in consideration of operation information such as engine rotation speed (engine rotation number Ne) sensed by a rotation speed sensor 21 or an accelerator position ACCP sensed by an accelerator position sensor 22 and correction based on engine cooling water temperature sensed by a cooling water temperature sensor 23 and fuel temperature sensed by a fuel temperature sensor 24. The ECU 10 applies the injector injection pulse to the injection control electromagnetic valve 4 of the injector 2 of each cylinder in accordance with the injection pulse width TQ calculated from the common rail pressure Pc sensed by a common rail pressure sensor 25 and the target injection amount. Thus, the engine is operated.

The ECU 10 has a pressure pattern estimation device and a surplus pressure range calculation device. The pressure pattern estimation device is configured with the injection period based on the required (target) injection amount and target common rail pressure and estimates a pressure transition of the fuel in the common rail 1 during the injection period. The surplus pressure range calculation device is configured with the target common rail pressure based on the pressure pattern data provided by the pressure pattern estimation device. The surplus pressure range calculation device calculates a surplus pressure range in which the pressure pattern data during the injection period exceeds the target common rail pressure. The ECU 10 operates the pressure reduction valve 8 of the common rail 1 to eliminate the surplus pressure range. The pressure pattern estimation device determines the injection period (injection amount TQ) of the injector 2 and the pump discharge amount (pressure-feeding amount) of the supply pump 3 based on the engine rotation speed Ne sensed by the rotation speed sensor 21, the common rail actual pressure Pc sensed by the common rail pressure sensor 25, the accelerator position ACCP sensed by the accelerator position sensor 22, common rail actual pressure measurement data obtained under the same and previous operation condition, and the like. Thus, the pressure pattern estimation device estimates the pressure transition of the fuel in the common rail 1. The surplus pressure range calculation device calculates the surplus pressure range by calculating a surplus pressure ΔP based on a following equation (1). In the equation (1), D represents the pump discharge amount, LQ is an injector leak amount, V is a volume of the common rail 1, and E is a fuel volumetric elastic coefficient determined by the fuel temperature, the pressure and a specific constant.

$$\Delta P=((D-(TQ+LQ))/V)\times E \quad (1)$$

If the calculated surplus pressure ΔP is equal to or greater than a specific pressure, the pressure reduction valve 8 is operated to discharge the fuel in the common rail 1 to a lower-pressure side to eliminate the surplus pressure range.

The ECU 10 has a pump discharge amount control device for performing discharge amount control of the supply pump 3. The pump discharge amount control device has an injection amount calculation device, a leak amount calculation device, a pump discharge amount calculation device, a control command value calculation device, and a pump drive device. The injection amount calculation device calculates the target (required) injection amount in accordance with the operation condition of the engine. The leak amount calculation device calculates the fuel leak amount leaking from sliding portions of the injectors 2 (injector leak amount). The pump discharge amount calculation device calculates the target pump discharge amount from the target injection amount and the injector leak amount. The control command value calculation device calculates the pump drive signal (drive current, control command value) supplied to the pump electromagnetic valve 7. The pump drive device outputs the pump drive signal to the pump electromagnetic valve 7 to drive the supply pump 3.

Figure 2:
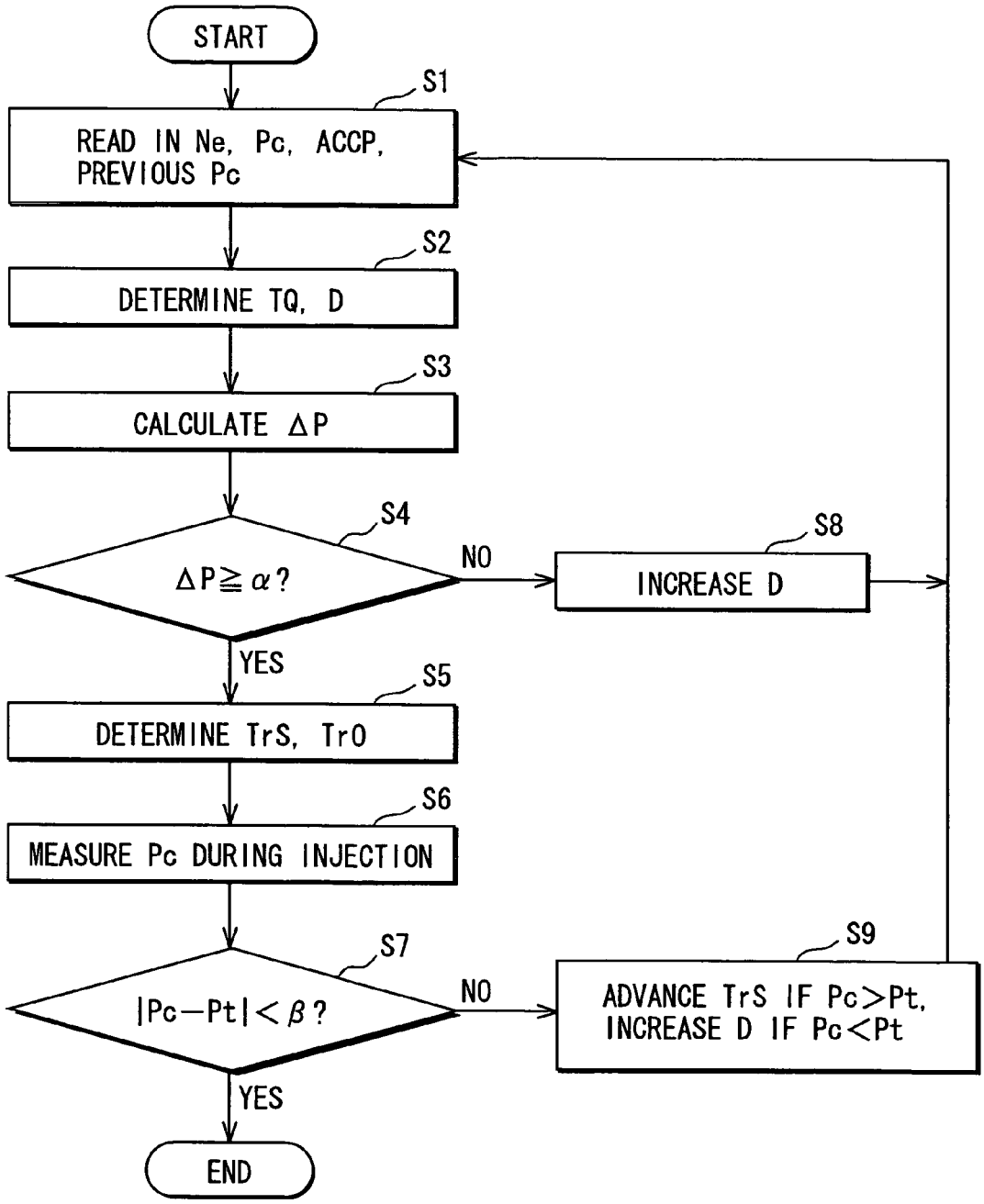
FIG. 2 is a flowchart showing an operation of the fuel injection controller according to the FIG. 1 embodiment.

Next, an operation of the pressure accumulation fuel injection controller according to the present embodiment will be explained. FIG. 2 shows a flowchart of an operation flow of the fuel injection control device according to the present embodiment. First, at Step S1, the ECU 10 reads in the engine rotation speed Ne sensed by the rotation speed sensor 21, the common rail actual pressure Pc sensed by the common rail pressure sensor 25, the accelerator position ACCP sensed by the accelerator position sensor 22, and the common rail actual measurement data measured under the same and previous operation condition. Then, at Step S2, the ECU 10 determines the injection period (injection amount TQ) of the injector 2 and the pump discharge amount D of the supply pump 3 based on the read sensing data. The pressure pattern estimation device performs the operations at Steps S1 and S2. Thus, the pressure transition of the fuel in the common rail 1 is estimated.

Then, at Step S3, the surplus pressure range calculation device calculates the surplus pressure ΔP based on the equation (1). The surplus pressure ΔP corresponds to the surplus pressure range over the target common rail pressure. Step S4 determines whether the surplus pressure ΔP is "equal to or higher than" a specified pressure α. If the answer to Step S4 is YES, the routine goes to Step S5. Step S5 determines start timing (operation timing) TrS for opening the pressure reduction valve 8 of the common rail 1 and the valve opening period TrO of the pressure reduction valve 8. The drive current supplied to the pressure reduction valve 8 is controlled by the duty cycle control. In this case, a difference between the common rail actual pressure sensed by the common rail pressure sensor 25 and the target common rail pressure is measured and fed back to the duty cycle control of the pressure reduction valve 8.

Step S6 measures the pressure Pc during the injection of the injector 2, which operates in retard of the pressure reduction valve 8, with the common rail pressure sensor 25. Then, Step S7 determines whether a difference between the pressure Pc during the injection measured by the common rail pressure sensor 25 and the target common rail pressure Pt is within a standard value β. If the answer to Step S7 is YES, the routine is ended.

If the answer to Step S4 is NO, the process goes to Step S8 and the pump discharge amount D of the supply pump 3 is increased. Then, the routine returns to Step S1. If the answer to Step S7 is NO, the routine goes to Step S9. If the pressure Pc measured during the injection is higher than the target common rail pressure Pt (if the difference is a positive pressure), the operation timing TrS of the pressure reduction valve 8 is advanced. If the measured pressure Pc is lower than the target common rail pressure Pt (if the difference is a negative pressure), the discharge amount D of the supply pump 3 is increased. Then, the routine returns to Step S1 to improve the learning function.

Next, a function and an effect of the pressure accumulation fuel injection controller according to the present embodiment will be explained through comparison with an operation of a conventional fuel injection controller of an engine shown in FIG. 3B. In FIG. 3B, a crank angle CA, an operation of a supply pump (PUMP), an injection rate R, and a fluctuation pattern of a common rail pressure Pc of the comparative example are shown. The engine of the comparative example has four cylinders #1–#4, and the supply pump has three plungers. Signs TDC#1–TDC#4 in FIG. 3B represent crank angles corresponding to top dead centers of the cylinders #1–#4 respectively. The supply pump driven by the engine provides phase differences with the three plungers and discharges the fuel to a common rail. Each shaded area in FIG. 3B represents a pressure-feeding period of the supply pump. Due to pulsation of the fuel discharged by the supply pump, the pressure in the common rail fluctuates in a waveform. If an injector periodically repeats the fuel injection for a predetermined injection period TQ, the pressure Pc in the common rail is reduced by a degree corresponding to an injection amount (injection ratio R) of the injector. Accordingly, a common rail pressure fluctuation pattern in the shape of a partly deficient waveform is provided as shown in FIG. 3B. Therefore, as shown by an area A in FIG. 3B, the common rail pressure Pc changes largely during the injection period TQ, so stable combustion cannot be obtained.

Figure 3A:
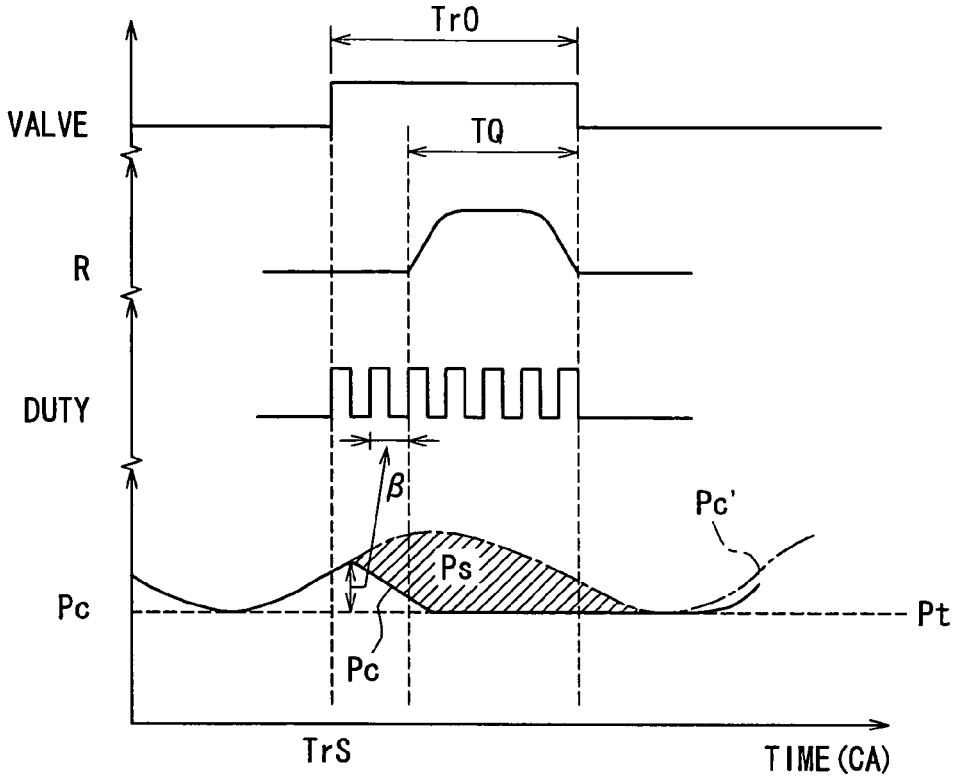
FIG. 3A is a diagram showing an operation of the fuel injection controller according to the FIG. 1 embodiment.
Figure 3B:
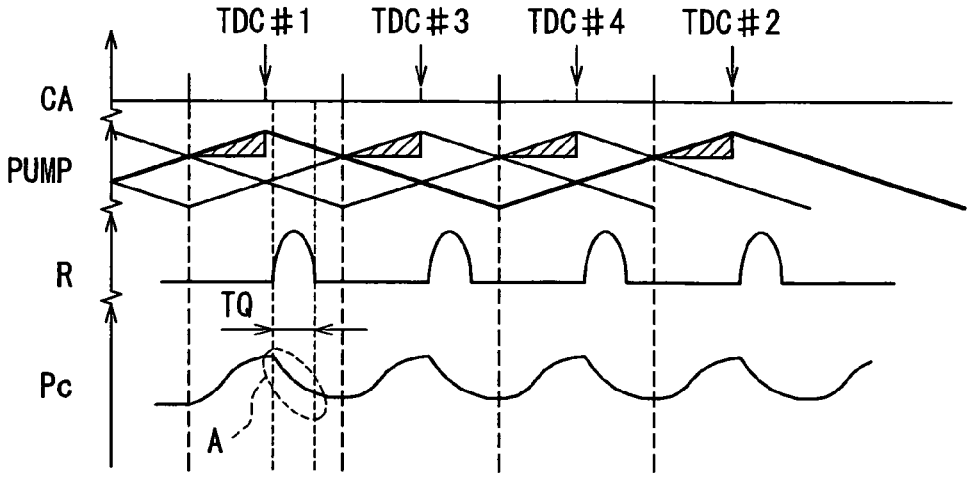
FIG. 3B RELATED ART
FIG. 3B is a diagram showing an operation of a fuel injection controller of a related art.

In contrast, in the present embodiment, the pressure reduction valve 8 mounted to the common rail 1 is operated to eliminate the surplus pressure range Ps as shown in FIG. 3A. In FIG. 3A, an operation of the pressure reduction valve 8 (VALVE), the injection rate R, the duty ratio (DUTY) of the duty cycle control of the pressure reduction valve 8, the fluctuation pattern of the common rail pressure Pc and the target common rail pressure Pt are shown. The valve opening start timing TrS of the pressure reduction valve 8 is set at a point when the common rail pressure Pc has increased to substantially a middle of the common rail pressure fluctuation pattern. For example, the valve opening start timing TrS is set at a point when the common rail pressure Pc becomes higher than the target common rail pressure Pt by approximately 5 MPa. The operation of the pressure reduction valve 8 is stopped immediately before the lowermost point of the common rail pressure fluctuation pattern. The operation of the pressure reduction valve 8 in the operation period is performed by the duty cycle control. A difference between the common rail actual pressure Pc sensed by the common rail pressure sensor 25 and the target common rail pressure Pt is measured and is fed back to the duty cycle control of the pressure reduction valve 8 as shown by an arrow mark B in FIG. 3A.

The injector 2 starts fuel injection in retard of the operation start of the pressure reduction valve 8 and ends the fuel injection at the same time as the operation end of the pressure reduction valve 8. Thus, the pressure reduction valve 8 is operated immediately before and during the injection. Accordingly, the common rail pressure fluctuation pattern is changed from a pattern shown by a chained line Pc' to a pattern shown by a solid line Pc in FIG. 3A. Thus, the surplus pressure range shown by a shaded area Ps in FIG. 3A is eliminated. Specifically, the common rail pressure Pc during the injection period is smoothed. Thus, the combustion and the performance of the engine are stabilized. Moreover, the combustion state and the fuel consumption are improved, and generation of smoke and the like is inhibited.

The target common rail pressure Pt shown by a broken line in FIG. 3A is set to achieve the best combustion state in the operation state. The pump discharge amount D of the supply pump 3 is set so that the lower limit value of the common rail pressure fluctuation pattern is invariably equal to or higher than the target common rail pressure Pt. It is because no control device is provided for performing increase control of the common rail pressure Pc and the value of the common rail pressure fluctuation pattern has to be maintained equal to or higher than the target common rail pressure Pt.

The present invention should not be limited to the disclosed embodiment, but may be implemented in many other ways without departing from the spirit of the invention.

What is claimed is:

1. A pressure accumulation fuel injection controller having a pressure accumulation vessel for accumulating high-pressure fuel, a fuel injection valve for injecting the high-pressure fuel accumulated in the pressure accumulation vessel into respective cylinders of an engine, and a fuel supply pump for pressurizing suctioned fuel and for pressure-feeding the fuel to the pressure accumulation vessel, wherein the fuel injection controller regulates the fuel discharge from the fuel supply pump into the pressure accumulation vessel to conform a common rail pressure in the pressure accumulation vessel to a target common rail pressure and injects the fuel from the injection valves into the cylinders, the fuel injection controller comprising:

a pressure pattern estimation device that is configured with an injection period based on a required injection amount and the target common rail pressure and that estimates a pressure transition of the fuel in the pressure accumulation vessel during the injection period;

a surplus pressure range calculation device that is configured with the target common rail pressure based on pressure pattern data provided by the pressure pattern estimation device and that calculates a surplus pressure range in which the pressure pattern data during the injection period exceeds the target common rail pressure; and a pressure reduction valve that performs control for discharging the common rail pressure to a lower-pressure side to eliminate the surplus pressure range calculated by the surplus pressure range calculation device.

2. The fuel injection controller as in claim 1, wherein the pressure pattern estimation device estimates the pressure transition of the fuel in the pressure accumulation vessel based on the injection period of the fuel injection valve and a discharge amount of the fuel supply pump determined in accordance with sensed data including common rail actual pressure measurement data obtained under the same and previous operation condition, engine rotation speed, common rail actual pressure and an accelerator position.

3. The fuel injection controller as in claim 1, wherein the fuel injection controller is structured so that a lower limit value of the pressure pattern data obtained by the pressure pattern estimation device is equal to or greater than the target common rail pressure.

4. The fuel injection controller as in claim 1, wherein the surplus pressure range calculation device calculates a surplus pressure in the pressure accumulation vessel from a discharge amount of the fuel supply pump and an injection amount and a leak amount of the fuel injection valve.

5. The fuel injection controller as in claim 1, wherein the pressure reduction valve is controlled with valve opening start timing and a valve opening period set to eliminate the surplus pressure range.

6. A control method of a pressure accumulation fuel injection device having a pressure accumulation vessel for accumulating high-pressure fuel, a fuel injection valve for injecting the high-pressure fuel accumulated in the pressure accumulation vessel into respective cylinders of an engine, and a fuel supply pump for pressurizing suctioned fuel and for pressure-feeding the fuel to the pressure accumulation vessel, the control method comprising:

a regulating step of regulating the fuel discharge from the fuel supply pump into the pressure accumulation vessel to conform a common rail pressure in the pressure accumulation vessel to a target common rail pressure;

a pressure pattern estimating step of estimating a pressure transition of the fuel in the pressure accumulation vessel during an injection period set based on a required injection amount and the target common rail pressure;

a surplus pressure range calculating step of calculating a surplus pressure range in which pressure pattern data during the injection period exceeds the target common rail pressure set based on the pressure pattern data, the pressure pattern data provided at the pressure pattern estimating step; and a pressure discharging step of discharging the common rail pressure to a lower-pressure side with a pressure reduction valve to eliminate the surplus pressure range calculated at the surplus pressure range calculating step.

7. The control method as in claim 6, wherein the pressure pattern estimating step estimates the pressure transition of the fuel in the pressure accumulation vessel based on the injection period of the fuel injection valve and a discharge amount of the fuel supply pump determined in accordance with sensed data including common rail actual pressure measurement data obtained under the same and previous operation condition, engine rotation speed, common rail actual pressure and an accelerator position.

8. The control method as in claim 6, wherein the control method is configured so that the a lower limit value of the pressure pattern data obtained at the pressure pattern estimating step is equal to or greater than the target common rail pressure.

9. The control method as in claim 6, wherein the surplus pressure range calculating step calculates a surplus pressure in the pressure accumulation vessel from a discharge amount of the fuel supply pump and an injection amount and a leak amount of the fuel injection valve.

10. The control method as in claim 6, wherein the pressure discharging step sets valve opening start timing and a valve opening period of the pressure reduction valve so as to eliminate the surplus pressure range.

* * * * *